US005212892A

United States Patent [19]

Maitlen et al.

[11] Patent Number: 5,212,892

[45] Date of Patent: May 25, 1993

[54] CUTTER HEAD ASSEMBLY FOR EXCAVATING MACHINE

[76] Inventors: C. Gene Maitlen, Rte. 4, Box 2632; Randall E. Maitlen, Rte. 4, Box 2630, both of Cushing, Okla. 74023; Tony A. Maitlen, 1809 Sunset Dr., Stillwater, Okla. 74074

[21] Appl. No.: 962,377

[22] Filed: Oct. 15, 1992

[51] Int. Cl.[5] ..... E02F 3/88

[52] U.S. Cl. ..... 37/66; 37/64; 37/189

[58] Field of Search ..... 37/66, 67, 65, 64, 60, 37/69, 70, 81, 85, 91, 94, 92, 189, DIG. 17, DIG. 8

[56] References Cited

U.S. PATENT DOCUMENTS

| | | | |
|---|---|---|---|
| 4,037,874 | 7/1977 | Willums | 37/66 X |
| 4,104,813 | 8/1978 | Lindsey | 37/66 X |
| 4,197,032 | 4/1980 | Miller | 37/189 X |
| 4,495,716 | 1/1985 | Finan et al. | 37/DIG. 17 X |
| 4,575,960 | 3/1986 | Deal | 37/66 X |
| 4,785,559 | 11/1988 | Henischel | 37/189 X |
| 4,852,277 | 8/1989 | Ward | 37/103 X |
| 4,896,445 | 1/1990 | Deal | 37/66 X |

*Primary Examiner*—Dennis L. Taylor
*Assistant Examiner*—J. Russell McBee
*Attorney, Agent, or Firm*—Dunlap, Codding & Lee

[57] ABSTRACT

A cutter head assembly attachable to a boom of an excavating machine. The cutter head assembly includes a frame and a cylindrical cutter drum under the frame and attached to the frame through a pair of motors and a pair of torque converters. A mounting bracket is provided on the top of the frame for attachment of the frame to the boom of an excavating machine. The cylindrical cutter drum has longitudinal cutter bars with teeth spaced along the length of the cutter bars. The torque converters are attached to the cutter drum with a pair of hub adapters. Resilient grommets are located between the hub adapters and the cutter drum to absorb shock occurring when the cutter drum strikes a hard surface or object. A supply pipe is mounted to the top of the frame to receive a solidifying agent, such as dry cement, for solidifying liquid waste. Four distribution pipes are connected to the supply pipe and extend downward through the frame to distribute the solidifying agent over the top of the cylindrical cutter drum.

14 Claims, 4 Drawing Sheets

CUTTER HEAD ASSEMBLY FOR EXCAVATING MACHINE

BACKGROUND OF THE INVENTION

1. Field of the Invention

The present invention relates to assemblies attachable to excavating machines for solidifying liquid waste.

2. Description of Related Art

U.S. Pat. No. 4,765,071 issued to Maitlen discloses a dredge cutter head with shock absorber. This cutter head is attached to the lowerable boom of a floating dredge for use in cutting and removing vegetation and sludge material from wastewater ponds, river beds and sea floors.

An object of the present invention is to utilize the shock absorbing construction of the dredge cutter head disclosed in U.S. Pat. No. 4,765,071 with a liquid waste solidifying cutter head which is attachable to and operable by an excavating machine.

Another object of the present invention is to provide improved teeth and torque capability for the cutter head drum to mix liquid waste and the underlying ground material into a homogeneous mixture.

Yet another object of the present invention is to provide a conduit for distributing a solidifying agent, such as dry cement, over the cutter head drum.

SUMMARY OF THE INVENTION

The present invention comprises a rectangular frame having a pair of end-plates attached to opposite ends of the frame. The end-plates extend downward from the frame to support a cutter drum between them. The cutter drum is adapted for rotation about its longitudinal axis beneath the frame.

A mounting bracket is attached to the upper surface of the frame. The mounting bracket is adapted for lock-pin attachment of the cutter head assembly to the operating boom of an excavating machine in a conventional manner. The excavating machine is typically propelled by a set of treads and has a hydraulic system for operating the boom and other functions of the machine.

The cutter drum comprises a plurality of cutter bars extending between two ring plates and supported by a plurality of circular rib plates in a cylindrical shape. A plurality of cutting teeth are attached to each cutter bar to cut and mix material as the cutter drum rotates.

A pair of hydraulic motors is provided to drive the rotation of the cutter drum. A torque converter is attached to each motor to supply increased torque to the rotation of the cutter drum. The cutter drum is attached to each torque converter through a hub adapter with shock absorbing grommets.

A supply pipe extends over the upper surface of the frame for the length of the cutter drum. A plurality of distribution pipes communicate with the supply pipe and extend through the frame. The supply pipe has an inlet collar for receiving a solidifying agent, such as dry cement, into the supply pipe. The distribution pipes dispense the solidifying agent over the top of the cutter drum.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
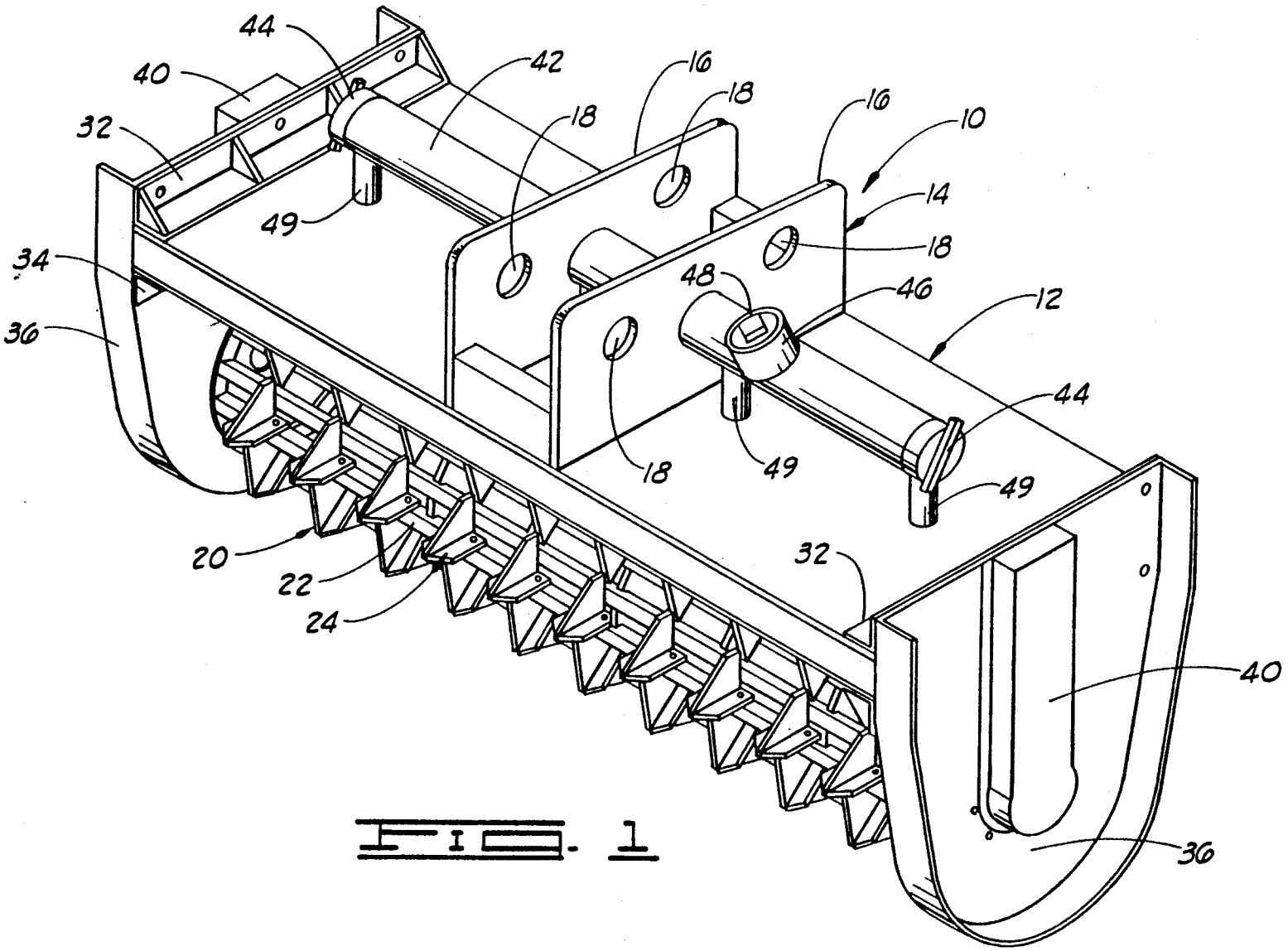
FIG. 1 is a perspective view of a cutter head assembly constructed in accordance with the present invention.

Referring now to the drawings in general, and to FIG. 1 in particular, shown therein and designated by the general reference numeral 10 is a cutter head assembly constructed in accordance with the present invention.

The cutter head assembly 10 includes a frame 12 having a mounting bracket 14. The mounting bracket 14 has a pair of mounting bracket plates 16 and each mounting bracket plate 16 includes a pair of mounting bracket holes 18. The mounting bracket holes 18 are located such that the cutter head assembly 10 is attachable by lock-pins to a boom (not shown) of a conventional excavating machine. When connected to the boom of an excavating machine, the cutter head assembly 10 may be raised, lowered and maneuvered by the boom of the excavating machine.

The cutter head assembly 10 also includes a cylindrical cutter drum 20, which is rotatably mounted to the frame 12. The cutter drum 20 is adapted for longitudinal rotation beneath the frame 12. As shown in FIG. 1, the cutter drum 20 has a plurality of cutter bars which extend for the length of the cutter drum 20. One of the cutter bars is designated by reference numeral 22 and is generally representative of the cutter bars of the cutter drum 20.

Continuing to refer to FIG. 1, a plurality of cutting teeth are attached to each cutter bar 22 in spaced relationship. One of the cutting teeth is indicated by reference number 24 and is generally representative of the cutting teeth of the cutter drum 20.

Figure 2:
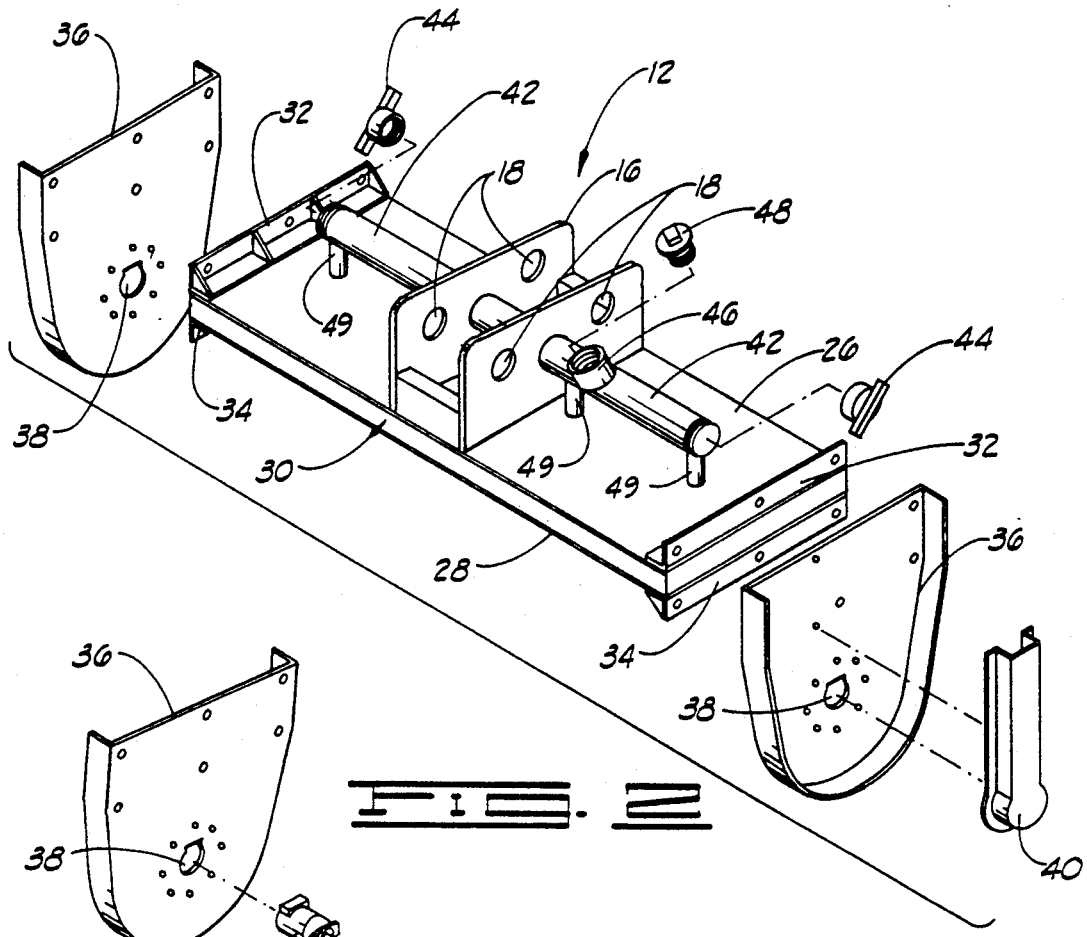
FIG. 2 is an exploded perspective view of the frame of the cutter head assembly.

Turning now to FIG. 2, the frame 12 of the cutter head assembly 10 is described in greater detail. The frame 12 includes a rectangular upper plate 26 and a rectangular lower plate 28, both of which are attached to a box subframe 30. The box subframe 30 has a plurality of reinforcing bars (not shown) which extend across the subframe 30 to provide additional strength and rigidity to the subframe 30.

An upper endplate mount 32 is rigidly attached to each end of the upper plate 26 and a lower endplate mount 34 is attached in a similar manner to each end of the lower plate 28. A drum mounting endplate 36 is connected to the upper and lower endplate mounts 32 and 34 on each side of the frame 12. As shown in FIG. 2, each drum mounting endplate 36 extends perpendicularly downward from the frame 12 and includes a motor-mount opening 38. In addition, each drum mounting endplate 36 has holes for bolt-mounting a hose guard 40. The hose guards 40 are provided to protect hydraulic hoses connected to hydraulic motors which drive rotation of the cutter drum 20.

With continued reference to FIG. 2, a supply pipe 42 extends through the mounting bracket plates 16 and over most of the length of the frame 12. Each end of the supply pipe 42 is threaded to receive an end cap 44 to enclose each end of the supply pipe 42. An inlet collar 46 is provided at a intermediate point of the supply pipe 42 for input of a solidifying agent into the supply pipe 42. The inlet collar 46 is threaded to receive an inlet cap 48 to close the inlet collar 46 when not in use.

A plurality of distribution pipes 49 are connected to the supply pipe 42 in a uniformly spaced arrangement. Each distribution pipe 49 communicates with the supply pipe 42 and extends completely through the upper and lower plates 26 and 28 of the frame 12. The lower end of each distribution pipe 49 is open to disperse dry cement over the cutter drum 20. The distribution pipes 49 are typically arranged to spread dry cement from the supply pipe 42 over the length of the cutter drum 20 as close as two inches from the cutter drum 20.

Figure 3:
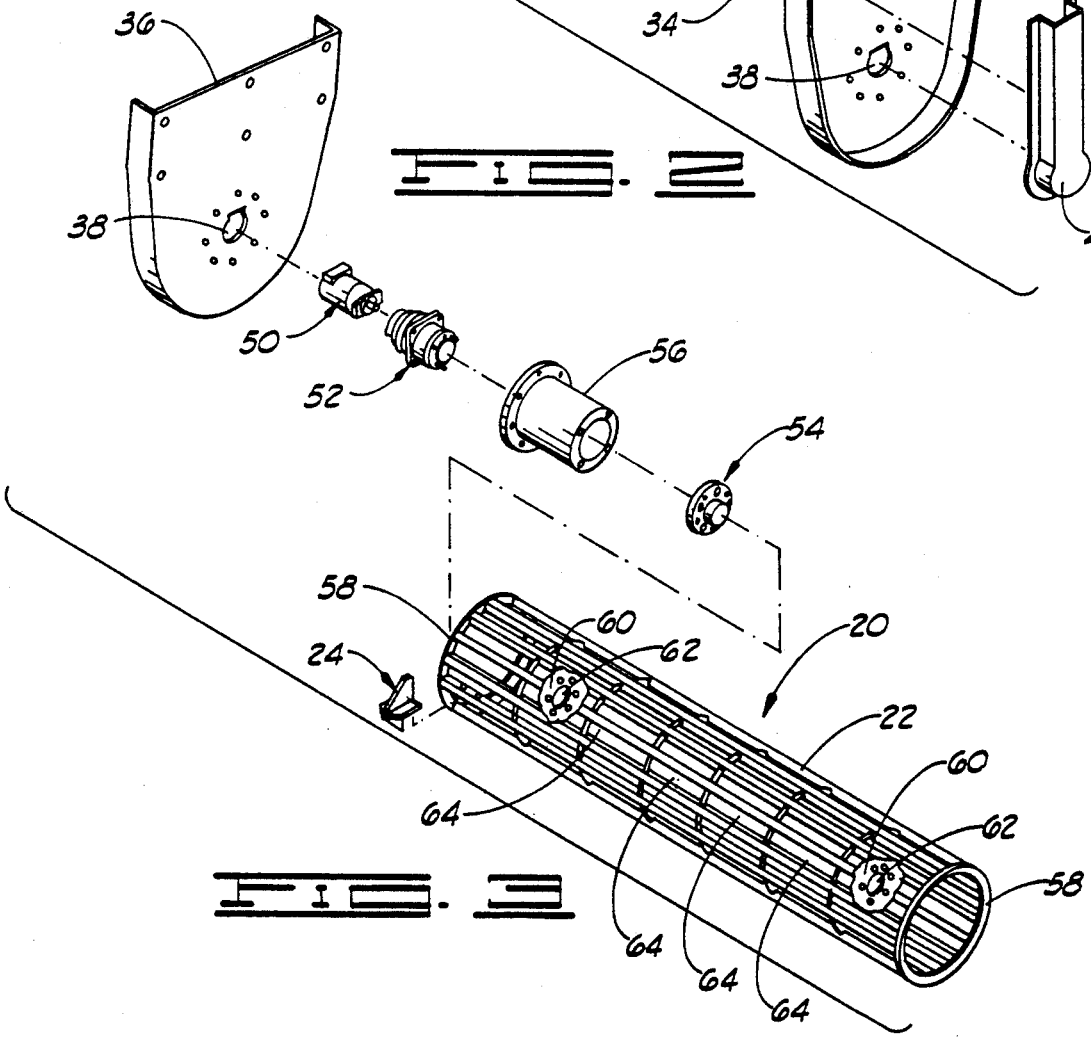
FIG. 3 a partly diagrammatic exploded perspective view of the drive and mounting arrangements of the cutter drum of the cutter head assembly. For clarity of illustration, only one side of the drive and mounting assembly and only one tooth of the cutter drum are shown.

Referring now to FIG. 3, the cutter drum 20 and its drive assembly is described in detail. The major components of the drive assembly are a hydraulic motor 50, a torque converter 52 and a hub adapter 54. The torque converter 52 and a portion of the motor 50 are contained within a drum-like thimble 56 to shield the torque converter 52 and the motor 50 from the liquid waste and sludge. For clarity of illustration, the drive assembly for only one side of the cutter drum 20 is shown in FIG. 3. It should be appreciated, however, that an identical drive assembly is provided at each end of the cutter drum 20.

The hydraulic motor 50 is a conventional motor such as a Sundstrand Model 20 series hydraulic motor.

The torque converter 52 is a conventional torque converter such as a Fairfield model S-3.

The cylindrical cutter drum 20 has a pair of ring-shaped cutter drum endplates 58 to which the ends of the cutter bars 22 are rigidly attached. Spaced to the inside of each cutter drum endplate 58 is a substantially circular cutter drum drive plate 60. As shown in the cut away areas of FIG. 3, each cutter drum drive plate 60 has a central hub opening 62 to receive the hub of the hub adapter 54 and a plurality of bolt-holes for attachment of the hub adapter 54. In addition, the cutter drum drive plates 60 have a plurality of circumferential cutouts. Each circumferential cutout is sized and shaped to receive a cross-sectional portion of one of the cutter bars 22.

Between the two cutter drum drive plates 60, a plurality of rib plates 64 are provided to support the cutter bars 22 in the medial portion of the cutter drum 20. Like the cutter drum drive plates 60, each rib plate 64 has a plurality of uniformly spaced circumferential cutouts in which a cross-sectional portion of the cutter bars 22 are fitted. The cutter bars 22 are rigidly attached by welding, or by any other suitable means, to the cutter drum endplates 58, the cutter drum drive plates 60 and the cutter drum rib plates 64.

The cutting teeth 24 are typically bolted to the cutter bars 22, but may be attached to the cutter bars 22 in any suitable manner. For clarity of illustration, only one of the cutting teeth 24 is shown in FIG. 3.

Figure 4:
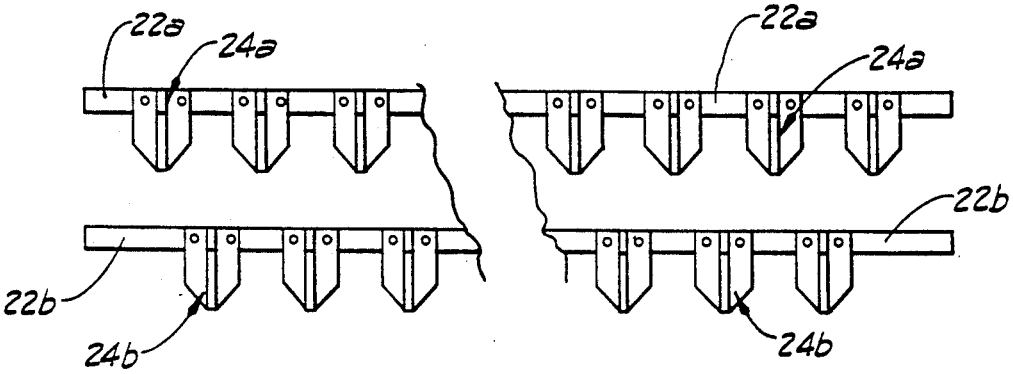
FIG. 4 is a diagrammatic view of a portion of a pair of cutter bars illustrating the arrangement of teeth on the cutter drum.

Turning now to FIG. 4, the arrangement of the cutting teeth 24 on the cutter bars 22 is described. Cutter bar 22*a* and cutter bar 22*b* generally represent any two adjacent cutter bars 22 of the cutter drum 20. For purposes of simplicity, middle portions of the cutter bars 22*a* and 22*b* are not shown in FIG. 4. The cutting teeth 24*a* and 24*b* are evenly spaced on adjacent cutter bars 22*a* and 22*b*, respectively. The cutting teeth 24*a*, however, are aligned with the spaces between the cutting teeth 24*b*. It should be appreciated that this staggered arrangement of cutting teeth 24*a* and 24*b* on adjacent cutter bars 22*a* and 22*b* is repeated all the way around the cutter drum 20. With this arrangement, the cutting teeth 24 make a continuous cut into the liquid waste and the surface beneath the liquid waste throughout the length of the cutter drum 20.

Figure 5:
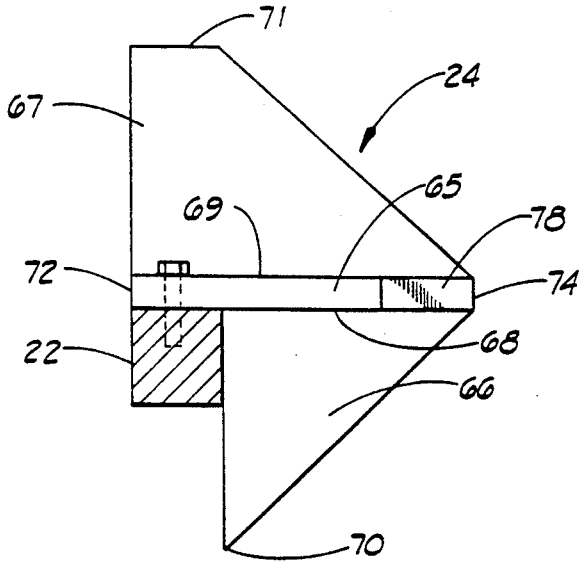
FIG. 5 is a side elevation of one of the teeth attached to the corresponding cutter bar.
Figure 6:
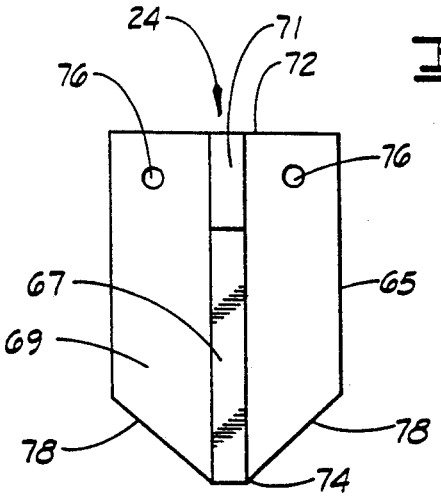
FIG. 6 is a top view of one of the teeth.
Figure 7:
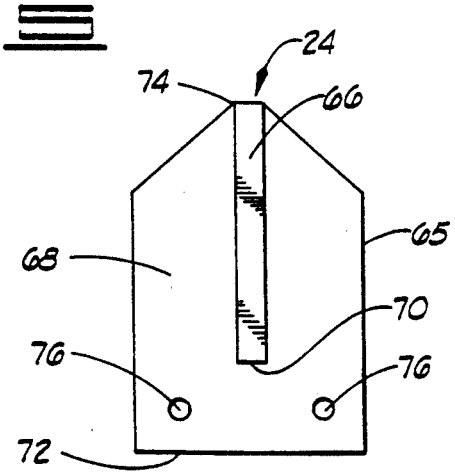
FIG. 7 is a bottom view of one of the teeth.

With reference now to FIGS. 5 through 7, the construction of the cutting teeth 24 is described in detail. As best shown in FIG. 5, each cutting tooth 24 has a base plate 65, a triangular plate 66 and a truncated triangular plate 67. The triangular plate 66 is rigidly attached to a first side 68 of the base plate 65, while the truncated triangular plate 67 is rigidly attached to a second opposite side 69 of the base plate 65. The triangular plate 66 and the truncated triangular plate 67 are both typically positioned to bisect the width of the base plate 65, to be parallel with the length of the base plate 65, and to be substantially perpendicular with the base plate 65.

As best shown in FIG. 5, one side of the triangular plate 66 is attached to the base plate 65 and the unattached point 70 of the triangular plate 66 extends from the base plate 65 and the corresponding cutter bar 22. Similarly, one side of the truncated triangular plate 67 is attached to the other side of the base plate 65 and the truncated side 71 of the truncated triangular plate 67 extends from the base plate 65.

The base plate 65 has an attaching end 72 and an extending end 74. On each side of the plates 66 and 67, the attaching end 72 of the base plate 65 has a bolt hole 76 for attachment of the cutting tooth 24 to one of the cutter bars 22. The extending end 74 of the base plate 65 has an angled area 78 on each side which allows the cutting tooth 24 to travel through material more easily at the extending end 74.

It should be appreciated that the cutter drum 20 is typically adapted for longitudinal rotation in either direction. Striking the surface with the triangular plate 66 produces a sharp cutting action, while the opposite rotation effects a duller, pounding effect by striking the surface with the truncated plate 67.

Figure 8:
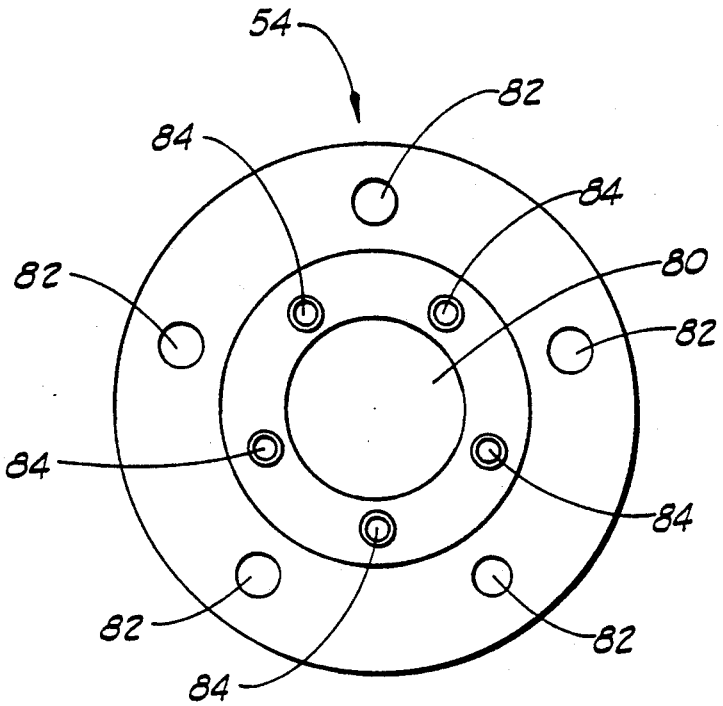
FIG. 8 is an end view of one of the hub adapters looking toward the hub side of the hub adapter.

Turning now to FIG. 8, the hub adapter 54 is described in detail. The hub adapter 54 is basically a circular plate with a centered hub 80 protruding from one side. Two sets of bolt holes extend through the hub adapter 54. The outer set of bolt holes, designated by reference number 82, are used for attachment of the hub adapter 54 to the drive plate 60 of the cutter drum 20. The inner set of bolt holes 84 are for attachment of the torque converter 52 to the hub adapter 54. The inner set of bolt holes 84 are countersunk.

Figure 9:
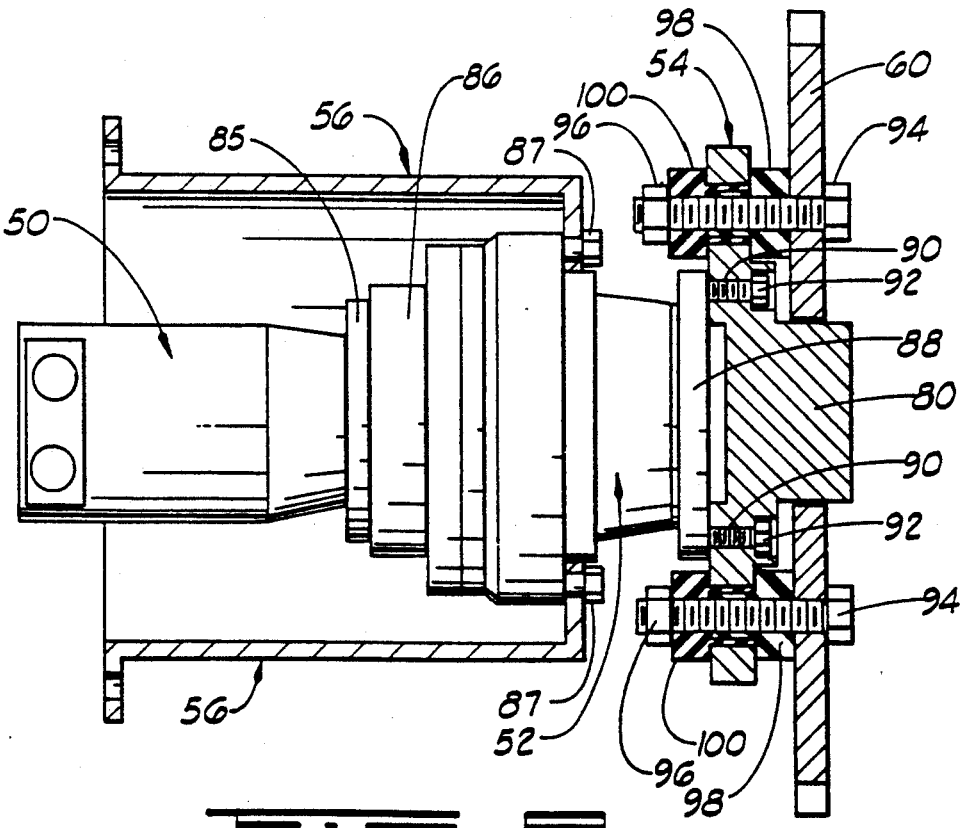
FIG. 9 is a partly diagrammatical, partly sectional top view illustrating the connection of the motor, torque converter, thimble, hub adapter and hub mount plate of the cutter head assembly.

The assembly of the drive components for the cutter drum 20 is illustrated in FIG. 9. As previously mentioned, each motor 50 extends through the motor opening 38 of the corresponding drum mounting endplate 36 of the frame 12. Each motor 50 is bolted to the corresponding drum mounting endplate 36. One of the thimbles 56 is also bolted to each drum mounting endplate 36 of the frame 12 and surrounds the corresponding torque converter 52 and part of the corresponding motor 50.

Each hydraulic motor 50 has a rotatable output end 85 which is attached to the input end 86 of the corresponding torque converter 52. Each torque converter 52 is supported by being bolted to the corresponding thimble 56 as illustrated by the bolts 87 in FIG. 9.

Each torque converter 52 has an output end 88 with a plurality of threaded studs 90. These threaded studs 90 are extended through the inner bolt holes 84 of the hub adapter 54 and a nut 92 is used to secure the torque converter 52 to the hub adapter 54. Because the inner bolt holes 84 of the hub adapter 54 are countersunk, the nuts 92 do not protrude from the hub adapter 54.

Continuing to refer to FIG. 9, a set of bolts 94 and nuts 96 are used to attach each hub adapter 54 to the corresponding drive plate 60 of the cutter drum 20. The bolts 94 extend through the outer bolt holes 82 of each hub adapter 54. When installed, the hub 80 of each hub adapter 54 extends through the hub opening 62 of the corresponding drive plate 60 of the cutter drum 20.

Sets of elastomeric grommets are provided to absorb shock as the cutter drum 20 rotates into the liquid waste and the material beneath the liquid waste. Each set of grommets has a male half 98 and a female half 100 which mate together to effect a cushion on each side of each hub adapter 54 as well as within the bolt holes 82. A metal bushing (not shown) is molded in the male half 98 to protect the grommets from damage by the bolts 94. The construction and installation of these grommet sets are described in U.S. Pat. No. 4,765,071 issued to Maitlen, which is hereby incorporated by reference.

In operation, the cutting head assembly 10 is attached to the boom of an excavator. Referring back to FIG. 1, one end of a dry cement supply hose (not shown) is connected to the inlet collar 46 of the supply pipe 42. The other end of the supply hose is connected to a conventional apparatus for forcing the solidifying agent, such as dry cement mix, into the supply pipe 42 under pressure.

The cutting head assembly 10 is lowered into the liquid waste to be solidified and on down to the surface beneath the liquid waste. The motors 50 are hydraulically driven to rotate the cutter drum 20 while the cement is spread over the top of the cutter drum 20 by the supply pipe 42 and distribution pipes 49. With the rotation of the cutter drum 20, the cutting teeth 24 chew into the liquid waste and the material beneath the liquid waste. In this manner, the chewed-up material and the cement are thoroughly mixed up to form a homogeneous sludge.

After the cutting head assembly 10 has formed the sludge, the cement is allowed to harden and solidify the sludge. Then the solid material can be loaded into trucks and transported without the leakage problems commonly associated with the transportation of liquid waste.

The cutting head assembly 10 may constructed and operated in various ways. As previously mentioned, the motors 50 are typically reversible and the cutter drum 20 may have either clockwise or counter-clockwise rotation. Although the cutting head assembly 10 is typically used with dry cement mix, any suitable solidifying agent may be utilized with the cutting head assembly 10.

The cutting head assembly 10 has been described as driven by hydraulic power. It should be appreciated that electric, pneumatic or any other suitable source of power may be used to drive and control the cutting head assembly 10.

Changes may be made in the combinations, operations and arrangements of the various parts and elements described herein without departing from the spirit and scope of the invention as defined in the following claims.

What is claimed is:

1. A cutter head assembly attachable to a boom of an excavating machine, the cutter head assembly comprising:

a frame having a top plate, a bottom plate, two opposing end plates extending downward from the frame, and a mounting bracket attached to the top plate, the mounting bracket being adapted for removable attachment of the frame to the boom of the excavating machine;

a pair of motors, each motor attached to one of the end plates of the frame and having a rotatable end;

a pair of torque converters, each torque converter corresponding to one of the motors and having an input end attached to the rotatable end of the corresponding motor and an output end adapted for rotation in response to the rotation of the input end thereof, the rotation of the output end of each torque converter producing greater torque than the rotation of the input end of the torque converter;

a cylindrical cutter drum having a plurality of longitudinally extending cutter bars, each end of the cylindrical cutter drum being attached to the output end of one of the torque converters; and a plurality of teeth attached to each cutter bar in spaced relation and extending from the outer periphery of the cutter drum;

wherein the cylindrical cutter drum rotates about the longitudinal axis thereof in response to rotation of the rotatable ends of the motors.

2. The cutter head assembly of claim 1 wherein the teeth attached to each one of the cutter bars are staggered in relation to the teeth of each adjacent cutter bar.

3. The cutter head assembly of claim 1 wherein each cutter tooth further comprises:

a base plate rigidly attached to the corresponding cutter bar of the cutter drum and having a first surface and an opposite second surface;

a first plate in the shape of a triangle and having one side of the triangle rigidly attached to the first surface of the base plate, the first plate being substantially perpendicular to the base plate; and a second plate in the shape of a triangle with a truncated portion, the second plate having the side of the triangle opposite the truncated portion rigidly attached to the second surface of the base plate, the second plate being substantially perpendicular to the base plate.

4. The cutter head assembly of claim 1 wherein the rotation of the rotatable ends of the motors is reversible.

5. The cutter head assembly of claim 1 wherein the motors are hydraulic.

6. The cutter head assembly of claim 1 further comprising:

distribution means for spreading a solidifying agent over the cutter drum.

7. The cutter head assembly of claim 6 wherein the distribution means further comprises:

a supply pipe extending above the frame and parallel with the cutter drum, the supply pipe having a collar for injecting a solidifying agent into the supply pipe; and a plurality of distribution pipes having one end communicating with the supply pipe and an opposite open end positioned to disperse a solidifying agent over the cutter drum.

8. The cutter head assembly of claim 1 wherein the cutter drum further comprises:

a pair of drive plates rigidly attached to the cutter bars and having a hub opening therethrough, each drive plate corresponding to one end of the cutter drum and being located inside the cutter drum and extending transversely across the cutter drum proximate to the corresponding end of the cutter drum.

9. The cutter head assembly of claim 8 further comprising:

a pair of hub adapters, each hub adapter having an outer side corresponding to one of the torque converters and an inner side corresponding to one of the drive plates of the cutter drum, the inner side of each hub adapter having a central protruding hub;

wherein the outer side of each hub adapter is attached to the output end of the corresponding torque converter and the inner side of each hub adapter is attached to the corresponding drive plate of the cutter drum and wherein the hub of each hub adapter extends through the hub opening of the corresponding drive plate of the cutter drum.

10. The cutter head assembly of claim 9 further comprising:

shock absorbing means, positioned between each hub adapter and the corresponding drive plate, for isolating physical shock to the cutter drum from the hub adapters.

11. The cutter head assembly of claim 9 wherein each hub adapter has a plurality of bolt-holes and each drive plate has a plurality of bolt-holes matching the bolt-holes of the corresponding hub adapter and wherein the cutter head assembly further comprises:

a plurality of bolts wherein one of the bolts extends through the bolt-hole of each hub adapter and the matching bolt-hole of the corresponding drive plate to attach each hub adapter to the corresponding drive plate of the cutter drum.

12. The cutter head assembly of claim 11 further comprising:

a grommet surrounding a portion of a corresponding one of the bolts, each grommet having a first portion positioned between the corresponding bolt and the corresponding hub adapter and a second portion positioned between the corresponding hub adapter and the corresponding drive plate.

13. The cutter head assembly of claim 12 wherein each grommet further comprises:

a female portion extending into the corresponding bolt-hole of the hub adapter and surrounding the corresponding bolt, the female portion having a female opening therethrough, the female opening being larger in diameter than the corresponding bolt to form an annular void between the female portion of the grommet and the corresponding bolt; and a male portion extending into the corresponding bolt-hole of the corresponding hub adapter around the corresponding bolt and into the annular void between the female portion and the corresponding bolt.

14. The cutter head assembly of claim 12 further comprising:

a bushing surrounding the threads of each bolt and positioned between the threads of the bolt and the corresponding grommet to protect the grommet from wear by the threads of the bolt.

* * * * *